US005803989A

United States Patent [19]

Kawamata et al.

[11] Patent Number: 5,803,989

[45] Date of Patent: Sep. 8, 1998

[54] PROCESS FOR PRODUCING NON-ORIENTED ELECTRICAL STEEL SHEET HAVING HIGH MAGNETIC FLUX DENSITY AND LOW IRON LOSS

[75] Inventors: Ryutaro Kawamata; Takeshi Kubota, both of Futtsu; Tomoji Kumano, Kitakyusyu, all of Japan

[73] Assignee: Nippon Steel Corporation, Tokyo, Japan

[21] Appl. No.: 765,858

[22] PCT Filed: Feb. 17, 1995

[86] PCT No.: PCT/JP95/00234

§ 371 Date: Dec. 19, 1996

§ 102(e) Date: Dec. 19, 1996

[87] PCT Pub. No.: WO96/00306

PCT Pub. Date: Jan. 4, 1996

[30] Foreign Application Priority Data

Jun. 24, 1994 [JP] Japan ..... 6/143181

[51] Int. Cl.[6] ..... H01F 1/147

[52] U.S. Cl. ..... 148/120; 148/111

[58] Field of Search ..... 148/111, 120

[56] References Cited

U.S. PATENT DOCUMENTS 5,421,912 6/1995 Kumano et al. ..... 148/111

FOREIGN PATENT DOCUMENTS 54-76422 6/1979 Japan .
56-33436 4/1981 Japan .
56-38422 4/1981 Japan ..... 148/120
57-35626 2/1982 Japan .
57-57829 4/1982 Japan .
58-136718 8/1983 Japan .
60-50117 3/1985 Japan .
60-194019 10/1985 Japan .
61-231120 10/1986 Japan .
3-193821 8/1991 Japan .
6-235026 8/1994 Japan .
6-240358 9/1994 Japan ..... 148/111
6-240359 9/1994 Japan ..... 148/111
6-240360 9/1994 Japan ..... 148/111
6-287639 10/1994 Japan ..... 148/111

*Primary Examiner*—John Sheehan
*Attorney, Agent, or Firm*—Kenyon & Kenyon

[57] ABSTRACT

A process for producing a non-oriented electrical steel sheet, comprising the steps of: hot rolling a non-oriented electrical steel sheet of a steel comprising at least one element selected from the group consisting of Si, Mn, and Al in respective amounts, in terms of by weight, satisfying the requirements $0.10\% \leqq Si \leqq 2.50\%$, $0.10\% \leqq Al \leqq 1.00\%$, $0.10\% \leqq Mn \leqq 2.00\%$, and the total amount of Si and Al being $(Si+2Al) \leqq 2.50\%$, with the balance consisting of Fe and unavoidable impurities, to prepare a hot rolled sheet; either subjecting the hot rolled sheet to single pass rolling to a final sheet thickness followed by finish annealing, or cold rolling the hot rolled sheet and then finish annealing the cold rolled sheet followed by skin pass rolling with a reduction ratio of 2 to 20% to a final sheet thickness, wherein the finishing in the step of finish hot rolling is performed in a temperature region of $(Ar_3+50)°$ C. or above, the strip coiling temperature is in a temperature region of the $Ar_1$ point or above, and, thereafter, in the coiled state, the strip is self-annealed in such a manner that the coil is held in the temperature range of from $(A_1-50)°$ C. to below $\{(A_1+A_3)/2\}°$ C. for 2 min to 3 hr.

6 Claims, 1 Drawing Sheet

PROCESS FOR PRODUCING NON-ORIENTED ELECTRICAL STEEL SHEET HAVING HIGH MAGNETIC FLUX DENSITY AND LOW IRON LOSS

TECHNICAL FIELD

The present invention relates to a process for producing a non-oriented electrical steel sheet, for use as iron core material for electrical machinery and apparatus, possessing excellent magnetic properties, i.e., a high magnetic flux density and a low iron loss.

BACKGROUND ART

In recent years, in the field of electrical machinery and apparatus, particularly rotary machines and medium and small size transformers where non-oriented electrical steel sheets are used as iron core materials, a trend toward saving electric power and energy and protecting the earth's environmental, such as the regulation of flon gas, has led to a rapid trend toward an increase in efficiency. For this reason, regarding non-oriented electrical steel sheets as well, there is an ever-increasing demand for improved properties, that is, high magnetic flux density and low iron loss.

In non-oriented electrical steel sheets, increasing the content of Si, Al or the like has been conducted as a method for lowering the iron loss from the viewpoint of reducing the eddy-current loss due to increased electric resistance. This method, however, has a problem that a lowering in magnetic flux density is unavoidable. Further, besides a mere increase in content of Si, Al or the like, lowering the contents of C, N, S, O or the like to increase the purity of the steel (Japanese Unexamined Patent Publication (Kokai) No. 61-231120) and improving the production process, such as a finish annealing cycle (Japanese Unexamined Patent Publication (Kokai) No. 57-35626) have been proposed. For all the above methods, although the iron loss could be lowered, no significant effect could be attained for the magnetic flux density. On the other hand, in order to improve the magnetic flux density by improving the texture of products, the regulation of the reduction ratio in cold rolling before finish annealing in a proper range to enrich ND//<110> orientation being effective for improving the magnetic flux density and having <100> orientation which is the axis of easy magnetization in the crystallographic axis, in the product sheet plane, within a primary recrystallized texture and, at the same time, to lower the integration of ND//<111>-based orientation having <111> orientation which is the direction of difficult magnetization in the crystallographic axis, in the product sheet plane, or the adoption of a hot rolled sheet annealing to coarsen the grain structure before cold rolling for the same purpose, or an increase in magnetic flux density by device of hot rolling conditions or the like have been attempted in the art. These methods, however, have not led to the production of non-oriented electrical steel sheets having a combination of high magnetic density with low iron loss and, hence, could not meet the demand for the non-oriented electrical steel sheets. In order to remove the above limit of the prior art, the present inventors have aimed at, and have made studies on, controlled hot rolling and conditions for self-annealing wherein annealing is performed by taking advantage of heat possessed by the coil after coiling of the hot rolled strip.

In the step of hot rolling a non-oriented electrical steel sheet having phase transformation, the grain diameter of the hot rolled sheet has been regulated to improve the magnetic properties of the product. Regarding the self-annealing of the hot-rolled sheet, Japanese Unexamined Patent Publication (Kokai) No. 54-76422 discloses a self-annealing technique, and the use of a heat-holding cover for ensuring the coil temperature during the self-annealing is specified in Japanese Unexamined Patent Publication (Kokai) No. 56-33436. Further, Japanese Unexamined Patent Publication (Kokai) Nos. 57-57829 and 60-50117 disclose a method wherein self-annealing conditions are properly set to coarsen the grain structure of the hot rolled sheet, thereby improving the magnetic property of the product, and Japanese Unexamined Patent Publication (Kokai) No. 58-136718 discloses a method wherein the finish hot rolling terminating temperature is brought to one in a $\gamma$ phase region followed by self-annealing. In the working examples of these known publications, the finish hot rolling terminating temperature is brought to one in a $\gamma$ region, transformation from $\gamma$ phase to $\alpha$ phase is performed in a cooling zone, and the grains are then grown during coiling in an $\alpha$ phase region. For this reason, in order to achieve the transformation to the $\alpha$ region after the completion of finish hot rolling, cooling on a run out table is regulated so as to satisfactorily ensure cooling, causing the steel sheet temperature to be excessively decreased with respect to the self-annealing temperature. This unfavorably renders the grain growth during the self-annealing unsatisfactory. In order to reduce the above drawback, it is necessary to reheat the coil during self-annealing. However, reheating during the self-annealing is likely to cause a heterogeneous temperature profile in the coil, rendering the grain structure of the hot rolled sheet heterogeneous and resulting in unsatisfactory coarsening. Further, reheating of the coil during the self-annealing is cost-ineffective from the viewpoint of operation and, hence, should be minimized.

In order to reduce the heterogeneity of the hot rolled structure provided by the self-annealing process, Japanese Unexamined Patent Publication (Kokai) No. 60-194019 discloses a method for regulating the cooling after self-annealing. Since, however, the mixed grain structure of the hot rolled sheet is attributable to the fact that the hot rolled structure is not homogeneously grown during the self-annealing, it is difficult to reduce the heterogeneity of the hot rolled structure by the regulation of the cooling rate after the completion of the self-annealing.

An object of the present invention is to solve the above problems of the prior art and to provide a non-oriented electrical steel sheet having high magnetic flux density and low iron loss.

DISCLOSURE OF INVENTION

The present inventors have made extensive and intensive studies with a view to overcoming the drawbacks of the prior art and to realizing better grain growth of the hot rolled structure during self-annealing than in the prior art to improve the magnetic flux density and, as a result, have found that the hot rolled grain structure is more homogeneously coarsened to not less than 150 $\mu$m in terms of average grain diameter as compared with the prior art, enabling the magnetic properties of the product to be significantly improved, by terminating finish rolling at a temperature above $(Ar_3+50)°$ C. in the step of hot rolling, coiling the strip in a temperature range of an $\alpha+\gamma$ duplex region or above, and properly regulating the self-annealing conditions so that the self-annealing temperature is in the range of from $(A_1-50)°$ C. to below $\{(A_1+A_3)/2\}°$ C. and the self-annealing time is 2 min to 3 hr, thereby regulating the transformation from $\gamma$ phase to $\alpha$ phase during self-annealing, which has led to the completion of the present invention.

Thus, the subject matter of the present invention resides in a process for producing a non-oriented electrical steel sheet having high magnetic flux density and low iron loss, comprising the steps of: hot rolling a slab of a steel having a composition, with αγ transformation, comprising at least one element selected from the group consisting of Si, Mn, and Al in respective amounts, in terms of by weight, satisfying the following requirements:

$$0.10\% \leqq Si \leqq 2.50\%,$$

$$0.10\% \leqq Al \leqq 1.00\%,$$

$$0.10\% \leqq Mn \leqq 2.00\%, \text{ and}$$

the total amount of Si and Al being $$Si+2Al \leqq 2.50\%,$$

with the balance consisting of Fe and unavoidable impurities, the finish hot rolling termination temperature being above $(Ar_3+50)°$ C.; coiling the hot rolled strip at a coiling temperature of above $(Ar^3+50)°$ C.; self-annealing the coiled strip in such a manner that the coil is held in the temperature range of from $(A_1-50)°$ C. to below $\{(A_1+A_3)/2\}°$ C. for 2 min to 3 hr; and pickling the self-annealed, hot rolled strip and then subjecting the strip to single pass cold rolling and finish annealing, or, after the self-annealing, pickling the self-annealed, hot rolled strip, cold rolling the pickled strip, finish annealing the cold-rolled strip, and then subjecting the annealed strip to skin pass rolling with a reduction ratio of 2 to 20%.

Thus, according to the present invention, coiling is performed in (α+γ) duplex region. In the prior art described in the above known publications, since the transformation from γ phase to α phase after the hot rolling results in refined grains of the hot rolled sheet, it has been regarded as detrimental to coarsening of the grains before cold rolling. For this reason, up to now, unlike the present invention, the utilization of the transformation from γ phase to a phase in the step of self-annealing has not been adopted. Specifically, although in the finishing temperature in the hot rolling and the coiling temperature described in the above publications, a variation in transformation point due to the change of constituents causes a change in the specified range, the chief aim is that the transformation from γ phase to a phase is performed during cooling after the completion of the finish hot rolling and grains are grown in the α phase after coiling. Therefore, the technical idea in the above publications is utterly different from that of the present invention wherein coiling is performed in (α+γ) duplex region.

BEST MODE FOR CARRYING OUT THE INVENTION

Figure 1A:
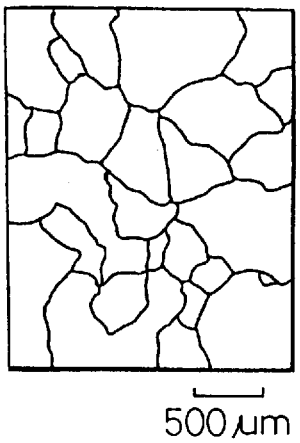
FIG. 1 (A) is a diagram showing the microstructure of a hot rolled sheet (A) according to the present invention, and FIG. 1 (B), FIG. 1 (C), FIG. 1 (D), and FIG. 1 (E) are diagrams showing the microstructure of comparative hot rolled sheets (B) to (E).

The present inventors have made extensive and intensive studies on the problems of the prior art with a view to simultaneously achieving low iron loss and high magnetic flux density and, as a result, have found that, in a non-oriented electrical steel sheet having transformation, coiling and self-annealing at the time of finish hot rolling under proper conditions in relation to the αγ transformation point successfully enables the production, at a low cost, of a non-oriented electrical steel sheet which, as a product after finish annealing, has very high magnetic flux density and good iron loss (low iron loss).

That is, according to the present invention, hot rolling conditions are specified to regulate the texture of a product after finish annealing, thereby producing a non-oriented electrical steel sheet which, as a product after finish annealing, has very high magnetic flux density and good iron loss (low iron loss).

In order to produce a non-oriented electrical steel sheet having low iron loss and high magnetic flux density in a non-oriented electrical steel sheet having transformation, it is necessary to adopt a method wherein, in the step of hot rolling of a non-oriented electric steel, sheet having α–γ transformation, the finish hot rolling termination temperature is brought to a temperature of $(Ar_3+50)°$ C. or above, coiling is performed at a temperature of α+γ region or above, i.e., a temperature above the $Ar_1$ point, and, thereafter, the strip in a coiled state is self-annealed in the temperature range of from $(A_1-50)°$ C. to below $\{(A_3+A_1)/2\}°$ C. for 2 min to 3 hr, thereby regulating the texture of the product after finish annealing. This realizes the production of a non-oriented electrical steel sheet having very high magnetic flux density and good iron loss (low iron loss).

At the outset, constituents of the steel sheet will be described. In the following description, all "%" are by weight. Si is added to increase the specific resistance of the steel sheet and to reduce the eddy-current loss, thereby improving the iron loss. When the Si content is less than 0.10%, the specific resistance is unsatisfactory. Therefore, the addition of Si in an amount of not less than 0.10% is necessary. On the other hand, when the Si content exceeds 2.50%, the α–γ transformation does not occur. For this reason, the Si content should be not more than 2.50%.

As with Si, Al has the effect of increasing the specific resistance of the steel sheet and reducing the eddy-current loss. For this purpose, the addition of Al in an amount of not less than 0.10% is necessary. On the other hand, an Al content exceeding 1.00% results in lowered magnetic flux density and increased cost, so that the Al content is limited to not more than 1.00%. Further, when (Si+2Al) exceeds 2.50%, the α–γ transformation does not occur. Therefore, (Si+2Al) should be not more than 2.50%.

As with Al and Si, Mn has the effect of increasing the specific resistance of the steel sheet and reducing the eddy-current loss. For this purpose, the addition of Mn in an amount of not less than 0.10% is necessary. On the other hand, when the Mn content exceeds 2.0%, the deformation resistance at the time of hot rolling is increased, making it difficult to conduct hot rolling and, at the same time, leading to a tendency for the grain structure after hot rolling to be refined. This results in deteriorated magnetic properties of the product. For this reason, the Mn content should be limited to not more than 2.0%. Further, since the addition of Mn lowers the αγ transformation point, the coiling in the duplex zone in the finish hot rolling according to the present invention can be performed on a lower temperature side, reducing the deteriorated coilability, after finish hot rolling, caused by enhancing the coiling temperature and enabling the formation of an oxide on the surface of a steel sheet to be inhibited, improving the yield at the time of pickling. Thus, the addition of Mn is effective in these points. The Mn content is preferably 0.30 to 1.50% from the viewpoint of regulating the transformation point.

The incorporation of at least one element selected from the group consisting of P, B, Ni, Cr, Sb, Sn, and Cu for improving the mechanical properties, magnetic properties and rust resistance and other purposes is not detrimental to the effect of the present invention.

Specifically, P is added in an amount in the range of from 0.02 to 0.1% from the viewpoint of improving the punchability of the product. When the amount of P added is less than 0.02%, the effect of improving the punchability cannot be attained, while when it exceeds 0.1%, the effect is saturated. In the case of P≦0.2%, no problem associated with the magnetic properties of the product is raised.

B is added to form BN at the time of hot rolling, inhibiting the formation of a fine precipitate of AlN, which render N harmless. The B content should be determined by taking into consideration the balance between the B content and the N content, and it should satisfy such a requirement that the ratio of the B content (%) to the N content (%) is 0.5 to 1.5. In the present invention, coarsening and coalescence of precipitates are performed after hot rolling, reducing the necessity of adding B.

Ni is added for increasing the yield stress of the steel sheet by taking advantage of solid solution strengthening, for improving the magnetic density, or for lowering the transformation point to improve the coilability as with Mn. The amount of Ni added is 0.1 to 3.0%. Preferably, it is 1.0 to 3.0% from the viewpoint of increasing the yield stress of the steel sheet, 0.5 to 2.5% from the viewpoint of improving the magnetic properties, and 1.0 to 2.5% from the viewpoint of regulating the transformation point. When the amount of Ni is not more than 0.1%, no effect can be attained for any purpose, while an Ni content exceeding 3.0% is unsuitable from the viewpoint of cost. For the above reason, the Ni content is limited to not more than 3.0%.

Cr is added in order to improve the rusting resistance. The amount of Cr added is 1.0 to 13.0% with the addition of Cr in an amount of 5.0 to 9.0% being more preferred. When the amount of Cr added is less than 1.0%, the effect of improving the rusting resistance cannot be attained, while an amount exceeding 13.0% is unsuitable from the viewpoint of cost. Therefore, the Cr content is limited to not more than 13.0%.

Sb is added to improve the texture and increase the magnetic flux density. The amount of Sb added is 0.02 to 0.2%. It is more preferably 0.03 to 0.15%. When the amount of Sb added is less than 0.01%, the effect of improving the texture is not attained. On the other hand, when it exceeds 0.2%, the grain growth at the time of finish annealing is inhibited, deteriorating the iron loss of the product. For this reason, the amount of Sb added is limited to not more than 0.2%.

Sn is added to improve the texture and increase the magnetic flux density. The amount of Sn added is 0.02 to 0.2%. It is more preferably 0.03 to 0.15%. When the amount of Sn added is less than 0.02%, the effect of improving the texture is not attained. On the other hand, when it exceeds 0.2%, the grain growth at the time of finish annealing is inhibited, deteriorating the iron loss of the product. For this reason, the amount of Sn added is limited to not more than 0.2%.

Cu is added to improve the texture and increase the magnetic flux density. The amount of Cu added is 0.1 to 1.0%. It is more preferably 0.1 to 0.4%. When the amount of Cu added is less than 0.1%, the effect of improving the texture is not attained. On the other hand, when it exceeds 1.0%, flaws are created on the surface of the steel sheet. For the above reason, the amount of Cu added is limited to not more than 1.0%.

Regarding other constituents, when the C content is not more than 0.050%, the object of the present invention can be attained. A low-grade non-oriented electrical steel sheet is used mainly in a small-size rotary machine, and grain growth during finish annealing after cold rolling or during strain relieving annealing should be accelerated from the viewpoint of lowering the iron loss, making it necessary to reduce fine precipitate in the steel. For this purpose, in general, the C content of the steel should be lowered. According to the present invention, after the coiling of the strip in the step of hot rolling is performed at the $Ar_1$ point or above, the coil is self-annealed in the temperature range of from $(A_1-50)°$ C. to below $\{(A_3+A_1)/2\}°$ C. for 2 min to 3 hr, carbides and other precipitates and inclusions are satisfactorily agglomerated and precipitated. Therefore, bringing the steel to an ultra low carbon steel is not required, and a C content of not more than 0.050% suffices for the present invention.

S and N are elements which are unavoidably included in the course of preparation of the steel by the melt process. S and N are partially redissolved as a solid solution during heating of the slab in the step of hot rolling, form precipitates of MnS and AlN during hot rolling, and inhibit the growth of recrystallized grains at the time of finish annealing or inhibit the movement of the magnetic wall at the time of magnetization of the product, that is, exhibit the so-called "pinning effect." which is causative of inhibition of a lowering in iron loss of the product. For this reason, the lower the content of S and N, the better the results. Therefore, there is no need to specify the lower limit of the content of S and N. In order to prevent the adverse effect of S and N on the magnetic properties, the S content and the N content each should be not more than 0.010% as in the prior art. In the present invention, however, as with C, S and N are rendered harmless by coarsening and agglomeration of the precipitates. Therefore, S≦0.020% and N≦0.020% suffice for the present invention.

Process conditions of the present invention will be described.

A steel slab comprising the above constituents is produced by preparing the steel in a converter followed by either continuous casting or ingot making/blooming. The steel slab is heated by a known method.

The slab is hot rolled to a predetermined thickness. In this case, the termination temperature of the finish hot rolling is above $(Ar_3+50)°$ C., and the hot rolled strip is coiled at a temperature of $Ar_1$ point or above. The coil is then self-annealed in the temperature range of from $(A_1-50)°$ C. to below $\{(A_3+A_1)/2\}°$ C., if necessary, by holding the heat by a known method, such as a method using a heat holding cover, or by using means such as auxiliary heating for temperature control of the coil.

When the finish hot rolling termination temperature is $(Ar_3+50)°$ C. or below, satisfactorily progress of recrystallization and grain growth before coiling is difficult, making it difficult to coarsen the grain structure by taking advantage of a synergistic effect of the grain growth during the self-annealing. Further, in this case, after the strip is passed through a finish hot rolling stand, it becomes difficult to ensure a coiling temperature of $Ar_1$ point or above while satisfactorily cooling the steel sheet in a cooling zone. This causes a large variation in temperature distribution of the steel sheet in the longitudinal direction due to unsatisfactory cooling, resulting in unstable coiling of the steel sheet, which remarkably deteriorates the shape of a strip of the hot rolled coil. Therefore, the finish hot rolling termination temperature is preferably above $(Ar_3+50)°$ C. In order to stabilize coiling after the finish hot rolling, the strip is usually cooled before coiling. However, if the strip could be stably coiled after the finish hot rolling, intentional cooling of the strip by water cooling after the completion of the finish hot rolling is not always required.

Regarding the finish hot rolling termination temperature, there is no need to set the upper limit. However, when the finish hot rolling termination temperature is excessively high, even hot rolling according to the conditions specified in the present invention results in unstable coarsening of α phase structure accompanying transformation from γ phase to α phase during self-annealing, which is likely to produce a mixed grain structure. For this reason, the finish hot rolling termination temperature is preferably 1150° C. or below.

According to the present invention, the coiling temperature is the $Ar_1$ point or above, preferably $\{(Ar_1+Ar_3)/2\}°$ C. or above. Coiling of the hot rolled sheet in the temperature range specified in the present invention enables the transformation to proceed from γ phase to α phase during self-annealing and, at the same time, permits untransformed γ phase to inhibit the grain growth of the α phase after the transformation. Further progress of the transformation from γ phase to α phase leads to disappearance of the untransformed γ phase, which inhibits the grain growth of the α phase, and, at the same time, the grain growth of the α phase, which has been inhibited by the untransformed γ phase, rapidly proceeds, bringing the grains to coarse grains, of the whole steel sheet, having an average diameter of about 150 μm or above. When the coiling temperature is below the $Ar_1$ point, the γ phase is absent in the structure of the steel sheet upon coiling. Consequently, coarsening of the grain structure based on the above principle does not occur. Therefore, the coiling temperature should be the $Ar_1$ point or above, preferably $\{(Ar_3+Ar_1)/2\}°$ C. or above.

When the self-annealing temperature exceeds the $A_1$ point, the γ phase is left after the completion of the self-annealing. The results of studies conducted by the present inventors show that, when the self-annealing temperature is brought to below $\{(A_1+A_3)/2\}°$ C. to control the amount of the residual γ phase at the time of the termination of the self-annealing, the growth of the α phase into coarse grains accompanying the disappearance of the γ phase occurs independently of the cooling rate after the completion of the self-annealing. However, when the self-annealing temperature was $\{(A_1+A_3)/2\}°$ C. or above, the volume fraction of the residual γ phase immediately after the completion of the self-annealing was increased and, during cooling after self-annealing, the hot rolled structure was frozen with the residual γ phase inhibiting the coarsening of α grains, increasing the volume fraction of fine grains in the hot rolled sheet to form a grain structure constituted by mixed grains. When a steel sheet product is produced from such a hot rolled sheet as a starting material, the magnetic properties of the product vary remarkably from site to site, rendering the product unacceptable. For this reason, the self-annealing temperature should be below $\{(A_1+A_3)/2\}°$ C.

When the self-annealing temperature is below $(A_1-50)°$ C., the growth of α grains during the self-annealing is unsatisfactory, making it impossible to provide non-oriented electrical steel sheets having excellent magnetic properties. For this reason, the self-annealing temperature should be $(A_1-50)°$ C. or above.

More preferably, the self-annealing temperature is $(A_1-50)°$ C. to the $A_1$ point from the viewpoint of permitting α grains to more stably proceed during self-annealing.

The following various experiments were carried out in order to investigate the influence of hot rolling conditions on the hot rolled grain structure. A steel slab comprising constituents, specified in Table 1, with the balance consisting of Fe and unavoidable impurities was produced in a converter by the melt process and cast into a 220 mm-thick slab using a continuous casting equipment. The $Ar_1$, $Ar_3$, $A_1$ and $A_3$ transformation points of this steel are given in Table 2. The slab was heated by a conventional method and hot rolled to a finish thickness of 2.5 mm. Hot rolling conditions and the results of observation of the microstructure of hot rolled sheets formed under respective hot rolling conditions are summarized in Table 3. The grain diameter given in Table 3 was measured by the intercept method specified in JISG0552, and the average grain diameter was expressed in terms of the equivalent circular diameter determined from grain size number.

Sample A of the present invention listed in Table 3 satisfies all the hot rolling requirements specified in the present invention. For sample B, the finish hot rolling temperature and the coiling temperature fall within the scope of the present invention and, although the self-annealing temperature is above $\{(A_1+A_3)/2\}°$ C., it is outside the scope of the present invention. For sample C, the finish hot rolling temperature and the coiling temperature fall within the scope of the present invention, and although the self-annealing temperature is below $(A_1-50)°$ C., it is outside the scope of the present invention. Sample D is a sample based on the conventional self-annealing process. Specifically, the finish hot rolling termination temperature was in γ region, and, before coiling, the strip was transformed on a cooling table into α region, followed by self-annealing in the α region. For sample E as a comparative example (prior art), the process involving annealing of the hot rolled sheet, that is, finish hot rolling termination, was carried out in γ region, the steel strip was then water-cooled, before coiling, on a cooling table to transform the steel strip into α region, coiled, and continuously annealed in α region to prepare a material as sample E.

As is apparent from the results of observation of the microstructure of the hot rolled sheet summarized in Table 3, for sample A, the hot rolled grain structure was constituted by coarse grains having a size of 150 μm or more, and no fine grain structure was found. In contrast, for sample B wherein the self-annealing temperature is above the temperature range specified in the present invention, the hot rolled grain structure was a mixed grain structure of coarse grains having a diameter of not less than 150 μm and a fine grain structure (a matrix) of grains having a diameter of not more than 100 μm.

For all of samples C, D, and E, the hot rolled grain structure was constituted by uniform grains having a diameter of not more than 100 μm.

Figure 1B:
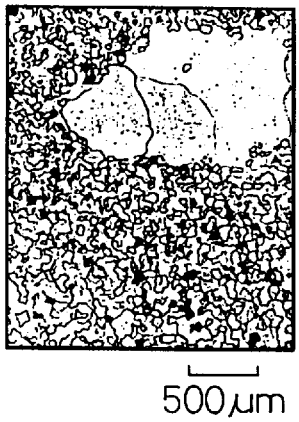
Figure 1C:
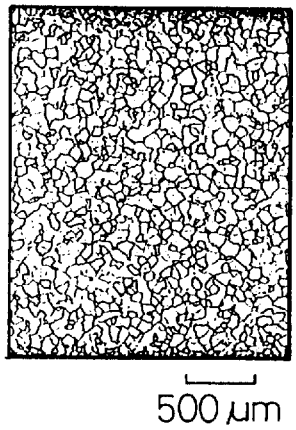
Figure 1D:
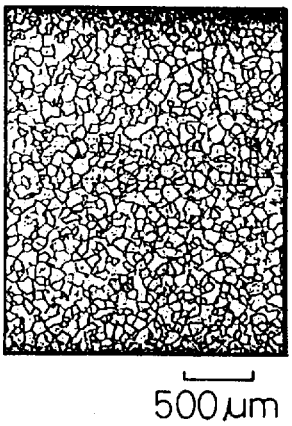
Figure 1E:
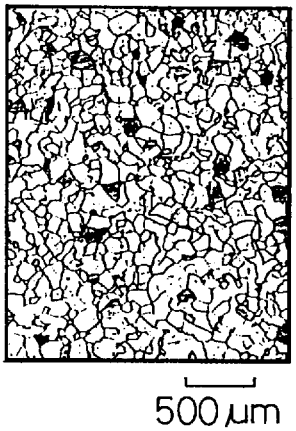

Thus, finish hot rolling so as to satisfy the hot rolling condition requirements specified in the present invention can bring the hot rolled grain structure to a structure constituted by uniform coarse grains having a diameter of not less than 150 μm. FIGS. 1 (A), 1 (B), 1 (C), 1 (D), and 1 (E) show microstructures of the hot rolled steel sheets for samples A to E.

TABLE 1

| C | Si | Mn | P | S | N (Unit: wt %) |
|---|---|---|---|---|---|
| 0.0021 | 0.50 | 1.00 | 0.051 | 0.0030 | 0.0019 |

TABLE 2

| $A_1$ point | $A_3$ point | $Ar_1$ point | $Ar_3$ point | $(A_1 + A_3)/2$ | $(Ar_1 + Ar_3)/2$ | $A_1$-50 (Unit: wt %) |
|---|---|---|---|---|---|---|
| 825 | 904 | 791 | 870 | 865 | 831 | 775 |

TABLE 3

| | | Hot roll finishing temp. | Coiling temp. | Self-annealing temp. | Annealing of hot rolled sheet | Observation results of hot rolled structure: Average grain diameter (μm) | Form |
|---|---|---|---|---|---|---|---|
| Sample A | Ex. of inv. | 950° C. | 850° C. | 820° C. | — | 339 | Uniform grains |
| B | Comp. Ex. (1) | 949° C. | 872° C. | 870° C. | — | *71 | Mixed grains |
| C | Comp. Ex. (2) | 951° C. | 863° C. | 770° C. | — | 90 | Uniform grains |
| D | Comp. Ex. (3) | 950° C. | 800° C. | 820° C. | — | 86 | Uniform grains |
| E | Comp. Ex. (4) | 949° C. | 700° C. | — | 820° C., 2 min | 99 | Uniform grains |

*Matrix portion

When the self-annealing time is less than 2 min, no satisfactory annealing effect can be attained resulting in unsatisfactory grain growth in the hot rolled structure, which makes it impossible to provide high magnetic flux density. When the self-annealing time is longer than 3 hr, the effect is saturated unfavorably resulting in lowered productivity. Further, excessive oxidization during self-annealing causes remarkable deterioration in a capability of being pickled in a later step, rendering the process unsuitable for practical use. For this reason, the self-annealing time is limited to 3 hr or less.

In the self-annealing, changing the interior of the heat holding cover to an $N_2$ inert gas atmosphere or to a vacuum state or alternatively evacuation followed by filling of an inert gas atmosphere, such as $N_2$, is also useful for attaining good pickling in the later step. The coil after predetermined self-annealing following coiling may be allowed to stand without any special treatment. However, after the completion of the self-annealing, preferably at the time when the temperature has lowered to 700° C. or below which decreases the grain growth rate of the α phase, cooling of the coil by means such as immersion in a water bath for providing good pickling in the later step is not detrimental to the effect of the present invention.

The hot rolled sheet thus obtained is then subjected to single-pass cold rolling and continuous annealing to give a sheet product. The reduction ratio in the cold rolling is 70 to 92%, preferably 74 to 83%. According to the present invention, increasing the reduction ratio in the cold rolling to about 90% brings about no significant lowering in magnetic flux density. The cold rolling may be performed by any of a tandem rolling machine, a reverse rolling machine, and a sendzimer rolling machine. Regarding rolling conditions, either heating of the coil in a hot bath such as water followed by rolling or warm rolling at a temperature of 100° C. or above for improving the rollability, improving the magnetic properties and other purposes poses no problem.

Continuous annealing conditions are preferably such that the continuous annealing is performed in a conventional continuous annealing furnace under a non-oxidizing atmosphere. However, continuous annealing in an oxidizing atmosphere for removing C left in the stage of steelmaking or for removing C incorporated into the steel sheet for other purposes poses no problem. Further, it is also possible to bring the annealing temperature to (α+γ) duplex region or γ region during the annealing from the viewpoint of improving the texture. Preferably, the annealing temperature is 700° to 1100° C., and the annealing time is 10 sec to 3 min. Further, from the viewpoint of inhibiting the oxidation of the steel sheet during annealing or other purposes, it is also possible to use such an annealing pattern that the steel sheet is heated in a first stage to a high temperature and, in a second stage, is annealed at a low temperature. When the annealing temperature is below 700° C., the recrystallization does not satisfactorily proceed, deteriorating the magnetic properties. Therefore, the annealing temperature should be 700° C. or above. On the other hand, when the annealing temperature is above 1100° C., flaws are created on the surface of the steel sheet during passage of the steel sheet through the system. Therefore, the annealing temperature is limited to 1100° C. or below. The optimal annealing temperature is determined according to the constituents of the steel sheet by taking into consideration the recrystallization temperature determined by constituents of the steel sheet and grain growth.

After continuous annealing following the cold rolling, the strip may be subjected to skin pass rolling to give a product. When the reduction ratio in the skin pass rolling is less than 2%, the effect of improving the iron loss cannot be attained, while when it exceeds 20%, the magnetic properties are deteriorated. For this reason, the reduction ratio in the skin pass rolling is 2 to 20%.

Further, according to the present invention, the finish annealing at a higher temperature for a longer annealing time than the conventional annealing to permit grain growth, thereby improving the iron loss, causes no lowering in magnetic flux density, realizing a combination of high magnetic flux density with low iron loss which has been unattainable in the prior art.

The finish hot rolling termination temperature, coiling temperature, and self-annealing conditions specified in the present invention is advantageous also from the viewpoints of finish annealing and rendering precipitates inhibiting grain growth during strain relieving annealing harmless.

In the case of hot rolling conditions based on conventional self-annealing and hot rolled sheet annealing, after terminating the finish hot rolling in γ region, the hot rolled sheet is rapidly cooled to α region and then coiled. By contrast, in order to satisfy the hot rolling condition requirements specified in the present invention, the hot rolled sheet is coiled in a temperature of the ($\alpha+\gamma$) duplex region or above, and the transformation from $\gamma$ phase to $\alpha$ phase is allowed to gradually proceed during self-annealing. This raises the coiling temperature, and, thereafter, the temperature gradually decreases during self-annealing, so that the holding time at a high temperature is longer than that in the prior art. As a result, harmful precipitates which inhibit grain growth, such as MnS, are coarsened by Ostwald growth, and precipitates are more effectively rendered harmless for grain growth as compared with the conventional self-annealing or hot rolled sheet annealing. Therefore, according to the hot rolling conditions according to the process of the present invention, since the precipitate in the hot rolled sheet is rendered harmless, a further improvement in iron loss over the conventional process, involving the self-annealing and hot rolled sheet annealing, has been adopted for coarsening the hot rolled grain structure.

When the slab heating temperature is raised, precipitates, such as MnS, are redissolved as a solid solution in the matrix phase during slab heating and finely reprecipitated during hot rolling, resulting in deteriorated iron loss of the product. Hot rolling specified in the present invention renders the precipitate harmless during self-annealing. Therefore, in the present invention, raising the slab heating temperature to one above that used in the prior art to ensure the finish hot rolling termination temperature does not result in deteriorated iron loss.

As described above, also from the viewpoint of rendering the precipitate harmless, the coiling temperature is preferably $Ar_1$ or above, more preferably $\{(Ar_1+Ar_3)/2\}°$ C. or above. Control in a period from finish hot rolling and coiling to self-annealing can render harmful precipitates serving as pinning sites of the magnetic walls in the product harmless, improving the iron loss property.

EXAMPLES

The present invention will be described with reference to the following examples.

Example 1

Steels having respective compositions comprising constituents specified in Table 4 with the balance consisting of Fe and unavoidable impurities were prepared by the melt process in a converter, and 220 mm-thick slabs were prepared in a continuous casting system. The $Ar_1$, $Ar_3$, $A_1$, and $A_3$ transformation points are given in Table 5. The slabs were heated by the conventional method and hot rolled to a finishing thickness of 2.5 mm. In this case, the hot rolling finishing temperature was $(Ar_3+50)°$ C. or above, and the coiling was performed on two levels, $Ar_1$ point or above and below $Ar_1$ point.

Immediately after the hot rolling, the coils were inserted into a heat holding cover and self-annealed at a predetermined temperature for 60 min. Thereafter, they were pickled and cold rolled to a finishing thicknesses of 0.50 mm and 0.55 mm. The 0.50 mm-thick cold rolled strips were annealed at 800° C. for 30 sec in the case of the composition 1 and at 850° C. for 30 sec in the case of the composition 2. On the other hand, the 0.55 mm-thick cold rolled strips were annealed in a continuous annealing furnace at 760° C. for 30 sec in the case of the composition 1 and at 820° C. for 30 sec in the case of the composition 2, finished by skin pass rolling with a reduction ratio of 9% to a thickness of 0.50 mm, and subjected to annealing at 750° C. for 2 hr which corresponds to annealing conducted by a customer. The magnetic properties of these samples were measured.

The coiling temperature, the self-annealing temperature, and the results of the magnetic measurement for the materials of the present invention and the comparative materials described in this example are summarized in Tables 6 and 7.

Thus, it has been found that the adoption of coiling at a temperature of the $Ar_1$ point or above can provide materials having a high magnetic flux density and a low iron loss for both the single pass method and the skin pass rolling method. For the comparative examples, since the coiling temperature was below the $Ar_1$ point, the magnetic properties were inferior to those in the case of the materials of the examples of the present invention even when the self-annealing temperature was in the range of from $\{(A_1+A_3)/2\}°$ C. to $(A_1-50)°$ C. Further, for both the composition 1 given in Table 6 and the composition 2 given in Table 7, the materials of Examples (1), (2), (5), and (6) wherein the coiling temperature was $\{(Ar_1+Ar_3)/2\}°$ C. or above had magnetic properties superior to the materials of Examples (3), (4), (7), and (8) wherein the coiling temperature was below $\{(Ar_3+Ar_1)/2\}°$ C.

TABLE 4

(Unit: wt %)

| Composition | C | Si | Mn | P | S | Al | N |
|---|---|---|---|---|---|---|---|
| 1 | 0.0027 | 0.25 | 0.30 | 0.050 | 0.0028 | 0.25 | 0.0020 |
| 2 | 0.0022 | 0.50 | 0.99 | 0.055 | 0.0030 | 0.21 | 0.0019 |

TABLE 5

| Composition | $A_1$ point (°C.) | $A_3$ point (°C.) | $Ar_1$ point (°C.) | $Ar_3$ point (°C.) | $(A_1 + A_3)/2$ (°C.) | $(Ar_1 + Ar_3)/2$ (°C.) | $A_1 - 50$ (°C.) |
|---|---|---|---|---|---|---|---|
| 1 | 900 | 971 | 875 | 947 | 936 | 911 | 850 |
| 2 | 847 | 942 | 807 | 901 | 895 | 854 | 797 |

TABLE 6

| Composition 1 | Hot roll finishing temp. | Coiling temp. | Self-annealing temp. | Skin pass rolling | Magnetic properties: Magnetic flux density (Tesla) B50 | Magnetic properties: Iron loss (W/kg) W17/50 |
|---|---|---|---|---|---|---|
| Ex. (1) | 1015° C. | 921° C. | 860° C. | Not done | 1.80 | 5.12 |
| Ex. (2) | 1015° C. | 921° C. | 860° C. | Done | 1.78 | 4.35 |
| Ex. (3) | 1009° C. | 889° C. | 860° C. | Not done | 1.79 | 5.35 |
| Ex. (4) | 1009° C. | 889° C. | 860° C. | Done | 1.77 | 4.60 |
| Comp. Ex. (1) | 1005° C. | 852° C. | 860° C. | Not done | 1.74 | 6.01 |
| Comp. Ex. (2) | 1005° C. | 852° C. | 860° C. | Done | 1.71 | 5.30 |

TABLE 6-continued

| Composition 1 | Hot roll finishing temp. | Coiling temp. | Self-annealing temp. | Skin pass rolling | Magnetic properties: Magnetic flux density (Tesla) B50 | Magnetic properties: Iron loss (W/kg) W17/50 |
|---|---|---|---|---|---|---|
| Comp. Ex. (3) | 1001° C. | 831° C. | 860° C. | Not done | 1.74 | 6.20 |
| Comp. Ex. (4) | 1001° C. | 831° C. | 860° C. | Done | 1.71 | 5.40 |

TABLE 7

| Composition 2 | Hot roll finishing temp. | Coiling temp. | Self-annealing temp. | Skin pass rolling | Magnetic properties: Magnetic flux density (Tesla) B50 | Magnetic properties: Iron loss (W/kg) W17/50 |
|---|---|---|---|---|---|---|
| Ex. (5) | 980° C. | 865° C. | 830° C. | Not done | 1.77 | 3.17 |
| Ex. (6) | 980° C. | 865° C. | 830° C. | Done | 1.75 | 2.71 |
| Ex. (7) | 981° C. | 842° C. | 830° C. | Not done | 1.76 | 3.30 |
| Ex. (8) | 981° C. | 842° C. | 830° C. | Done | 1.74 | 2.90 |
| Comp. Ex. (5) | 980° C. | 804° C. | 830° C. | Not done | 1.73 | 3.75 |
| Comp. Ex. (6) | 980° C. | 804° C. | 830° C. | Done | 1.70 | 3.25 |
| Comp. Ex. (7) | 982° C. | 793° C. | 830° C. | Not done | 1.72 | 4.11 |
| Comp. Ex. (8) | 982° C. | 793° C. | 830° C. | Done | 1.69 | 3.51 |

Example 2

Steels having respective compositions comprising constituents specified in Table 8 with the balance consisting of Fe and unavoidable impurities were prepared by the melt process in a converter, and 220 mm-thick slabs were prepared in a continuous casting system. The $Ar_1$, $Ar_3$, $A_1$, and $A_3$ transformation points are given in Table 9. The slabs were heated by the conventional method and hot rolled to a finishing thickness of 2.5 mm. In this case, the coiling temperature was $Ar_1$ point or above, the self-annealing was performed on four temperature levels for each composition, and the self-annealing time was 60 min.

Thereafter, the strips were pickled and cold rolled to finishing thicknesses of 0.50 mm and 0.55 mm. The 0.50 mm-thick cold rolled strips were annealed at 800° C. for 30 sec in the case of the composition 3 and at 850° C. for 30 sec in the case of the composition 4. On the other hand, the 0.55 mm-thick cold rolled strips were annealed in a continuous annealing furnace at 760° C. for 30 sec in the case of the composition 3 and at 820° C. for 30 sec in the case of the composition 4, finished by skin pass rolling with a reduction ratio of 9% to a thickness of 0.50 mm, and subjected to annealing at 750° C. for 2 hr which corresponds to annealing conducted by a customer. The magnetic properties of these samples were measured.

The coiling temperature, the self-annealing temperature, and the results of the magnetic measurement for the materials of the present invention and the comparative materials described in this example are summarized in Tables 10 and 11.

TABLE 8

(Unit: wt %)

| Composition | C | Si | Mn | P | S | Al | N |
|---|---|---|---|---|---|---|---|
| 3 | 0.0021 | 0.30 | 0.12 | 0.070 | 0.0025 | 0.0005 | 0.0022 |
| 4 | 0.0021 | 0.51 | 1.01 | 0.051 | 0.0029 | 0.15 | 0.0021 |

TABLE 9

| Composition | $A_1$ point (°C.) | $A_3$ point (°C.) | $Ar_1$ point (°C.) | $Ar_3$ point (°C.) | $(A_1 + A_3)/2$ (°C.) | $(Ar_1 + Ar_3)/2$ (°C.) | $A_1 - 50$ (°C.) |
|---|---|---|---|---|---|---|---|
| 3 | 900 | 947 | 874 | 918 | 924 | 896 | 850 |
| 4 | 839 | 929 | 805 | 895 | 884 | 850 | 789 |

TABLE 10

| Composition 3 | Hot roll finishing temp. | Coiling temp. | Self-annealing temp. | Skin pass rolling | Magnetic properties: Magnetic flux density (Tesla) B50 | Magnetic properties: Iron loss (W/kg) W17/50 |
|---|---|---|---|---|---|---|
| Ex. (9) | 985° C. | 901° C. | 870° C. | Not done | 1.79 | 5.20 |
| Ex. (10) | 985° C. | 901° C. | 870° C. | Done | 1.77 | 4.45 |
| Ex. (11) | 984° C. | 890° C. | 860° C. | Not done | 1.78 | 5.23 |
| Ex. (12) | 984° C. | 890° C. | 860° C. | Done | 1.76 | 4.46 |
| Comp. Ex. (9) | 985° C. | 885° C. | 835° C. | Not done | 1.75 | 6.09 |
| Comp. Ex. (10) | 985° C. | 885° C. | 835° C. | Done | 1.72 | 5.40 |

TABLE 10-continued

| Composition 3 | Hot roll finishing temp. | Coiling temp. | Self-annealing temp. | Skin pass rolling | Magnetic properties: Magnetic flux density (Tesla) B50 | Magnetic properties: Iron loss (W/kg) W17/50 |
|---|---|---|---|---|---|---|
| Comp. Ex. (11) | 985° C. | 880° C. | 810° C. | Not done | 1.74 | 6.11 |
| Comp. Ex. (12) | 985° C. | 880° C. | 810° C. | Done | 1.71 | 5.50 |

TABLE 11

| Composition 4 | Hot roll finishing temp. | Coiling temp. | Self-annealing temp. | Skin pass rolling | Magnetic properties: Magnetic flux density (Tesla) B50 | Magnetic properties: Iron loss (W/kg) W17/50 |
|---|---|---|---|---|---|---|
| Ex. (13) | 974° C. | 835° C. | 820° C. | Not done | 1.77 | 3.22 |
| Ex. (14) | 974° C. | 835° C. | 820° C. | Done | 1.75 | 2.80 |
| Ex. (15) | 971° C. | 836° C. | 800° C. | Not done | 1.77 | 3.29 |
| Ex. (16) | 971° C. | 836° C. | 800° C. | Done | 1.75 | 2.83 |
| Comp. Ex. (13) | 973° C. | 832° C. | 780° C. | Not done | 1.72 | 3.80 |
| Comp. Ex. (14) | 973° C. | 832° C. | 780° C. | Done | 1.69 | 3.42 |
| Comp. Ex. (15) | 976° C. | 833° C. | 760° C. | Not done | 1.71 | 3.91 |
| Comp. Ex. (16) | 976° C. | 833° C. | 760° C. | Done | 1.68 | 3.51 |

Thus, it was found that when the self-annealing temperature was in the range of from $(A_1-50)°$ C. to below $\{(A_1+A_3)/2\}°$ C., both the single pass method and the skin pass rolling process can provide materials having high magnetic flux density and low iron loss.

INDUSTRIAL APPLICABILITY

The non-oriented electrical steel sheets provided according to the present invention have excellent magnetic properties, i.e., high magnetic flux density and low iron loss, and, hence, are applicable as iron core materials for electrical machinery and apparatus, leading to a high possibility that they will be extensively utilized in the field of rotary machines and medium and small size transformers.

We claim:

1. A process for producing a non-oriented electrical steel sheet having high magnetic flux density and low iron loss, comprising the steps of: hot rolling a slab of a steel having a composition, having $\alpha\gamma$ transformation, comprising at least one element selected from the group consisting of Si, Mn, and Al in respective amounts, in terms of by weight, satisfying the following requirements:

$$0.10\% \leqq Si \leqq 2.50\%,$$

$$0.10\% \leqq Al \leqq 1.00\%,$$

$$0.10\% \leqq Mn \leqq 2.00\%, \text{ and}$$

the total amount of Si and Al being $$Si+2Al \leqq 2.50\%,$$

with the balance consisting of Fe and unavoidable impurities; coiling the hot rolled strip, after the finish hot rolling, at a coiling temperature of the $Ar_1$ point or above; self-annealing the coiled strip in such a manner that the coil is held in the temperature range of from $(A_1-50)°$ C. to below $\{(A_1+A_3)/2\}°$ C. for 2 min to 3 hr; pickling the self-annealed, hot rolled strip and then subjecting the strip to single pass cold rolling to a final sheet thickness; and finish annealing the cold rolled steel sheet.

2. The process according to claim 1, wherein the self-annealed steel strip is pickled, cold rolled, finished annealed, and then subjected to skin pass rolling with a reduction ratio of 2 to 20% to a final sheet thickness.

3. The process according to claim 1, wherein the finish hot rolling termination temperature is above $(Ar_3+50)°$ C.

4. The process according to claim 2, wherein the finish hot rolling termination temperature is above $(Ar_3+50)°$ C.

5. The process according to claim 1, wherein the coiling temperature after the finish hot rolling is $\{(Ar_1+Ar_3)/2\}°$ C. or above.

6. The process according to claim 2, wherein the coiling temperature after the finish hot rolling is $\{(Ar_1+Ar_3)/2\}°$ C. or above.

* * * * *

UNITED STATES PATENT AND TRADEMARK OFFICE

CERTIFICATE OF CORRECTION

PATENT NO. : 5,803,989

DATED : September 8, 1998

INVENTOR(S) : Ryutaro KAWAMATA, et al.

It is certified that error appears in the above-identified patent and that said Letters Patent is hereby corrected as shown below:

Column 3, line 21, change "$Ar^3$+50)° C.;" to --the Ari point;--.

Column 3, line 38, change "a" to --α--.

Column 3, line 44, change "a" to --α--.

Column 4, line 15, delete the comma after "steel".

Column 5, line 12, change "render" to --renders--.

Column 10, line 61, change "is" to --are--.

Column 16, line 41, change "finished" to --finish--.

Signed and Sealed this

Twenty-first Day of November, 2000

*Attest:*

Q. TODD DICKINSON

*Attesting Officer*

*Director of Patents and Trademarks*